US009956786B2

(12) United States Patent
Kobayashi

(10) Patent No.: US 9,956,786 B2
(45) Date of Patent: May 1, 2018

(54) LIQUID DISCHARGE HEAD AND RECORDING DEVICE

(71) Applicant: KYOCERA Corporation, Kyoto-shi, Kyoto (JP)

(72) Inventor: Naoki Kobayashi, Kirishima (JP)

(73) Assignee: KYOCERA CORPORATION, Kyoto (JP)

( * ) Notice: Subject to any disclaimer, the term of this patent is extended or adjusted under 35 U.S.C. 154(b) by 0 days. days.

(21) Appl. No.: 15/506,962

(22) PCT Filed: Aug. 27, 2015

(86) PCT No.: PCT/JP2015/074252
§ 371 (c)(1),
(2) Date: Mar. 8, 2017

(87) PCT Pub. No.: WO2016/031920
PCT Pub. Date: Mar. 3, 2016

(65) Prior Publication Data

US 2017/0253037 A1 Sep. 7, 2017

(30) Foreign Application Priority Data

Aug. 28, 2014 (JP) ..... 2014-174100

(51) Int. Cl.
*B41J 2/18* (2006.01)
*B41J 2/155* (2006.01)
*B41J 2/14* (2006.01)

(52) U.S. Cl.
CPC ..... *B41J 2/18* (2013.01); *B41J 2/14201* (2013.01); *B41J 2/155* (2013.01); *B41J 2002/14467* (2013.01); *B41J 2202/12* (2013.01)

(58) Field of Classification Search
CPC . B41J 2/18; B41J 2/155; B41J 2/14201; B41J 2002/14467; B41J 2202/12
See application file for complete search history.

(56) References Cited

U.S. PATENT DOCUMENTS

2010/0238238 A1 9/2010 Yamamoto
2013/0233939 A1* 9/2013 Uezawa ..... B41J 2/14274 239/102.1

(Continued)

FOREIGN PATENT DOCUMENTS

JP 2010-214847 A 9/2010

*Primary Examiner* — Julian Huffman
(74) *Attorney, Agent, or Firm* — Volpe and Koenig, P.C.

(57) ABSTRACT

A liquid discharge head may reduce possibility that pressure from a discharge unit reaches a third channel and a fourth channel. The liquid discharge head includes a plurality of discharge units each including a discharge hole, a pressurization chamber communicating with the discharge hole, a first channel for liquid supply to the pressurization chamber, and a second channel for liquid collection from the pressurization chamber, a pressurizing part configured to pressurize the pressurization chamber, a third channel connected commonly to the first channels of the plurality of discharge units, the third channel for liquid supply to the discharge units, a fourth channel connected commonly to the second channels of the plurality of discharge units, the fourth channel for liquid collection from the discharge units, and a fifth channel connecting the discharge units and having channel resistance larger than channel resistance of the first channel and the second channel.

13 Claims, 9 Drawing Sheets

(56) References Cited

U.S. PATENT DOCUMENTS

| | | | | |
|---|---|---|---|---|
| 2015/0273831 | A1* | 10/2015 | Hirai | B41J 2/14201 347/71 |
| 2016/0375682 | A1* | 12/2016 | Matsuda | B41J 2/04581 347/10 |
| 2017/0182772 | A1* | 6/2017 | Gejima | B41J 2/14274 |

* cited by examiner

LIQUID DISCHARGE HEAD AND RECORDING DEVICE

TECHNICAL FIELD

The present invention relates to a liquid discharge head and a recording device.

BACKGROUND ART

A conventionally known printing head is exemplified by a liquid discharge head including: a plurality of discharge units each provided with a discharge hole, a pressurization chamber communicating with the discharge hole, a first channel for supply of liquid to the pressurization chamber, and a second channel for collection of liquid from the pressurization chamber; a pressurizing part configured to pressurize the pressurization chamber; a third channel connected commonly to the first channels of the discharge units, the third channel for supply of liquid to the discharge units; and a fourth channel connected commonly to the second channels of the discharge units, the fourth channel for collection of liquid from the discharge units (see Patent Document 1 or the like).

In each of the discharge units of the liquid discharge head, the pressurizing part pressurizes the pressurization chamber to generate pressure applied to liquid in the pressurization chamber, so that the liquid is discharged from the discharge holes to a recording medium for printing.

RELATED ART DOCUMENT

Patent Document

Patent Document 1: JP 2010-214847 A

SUMMARY OF THE INVENTION

Problem to be Solved by the Invention

The pressure generated in the pressurization chamber, however, may partially be transmitted to the first channel and the second channel communicating with the pressurization chamber. In this case, the pressure may reach the third channel and the fourth channel connected commonly to the discharge units to adversely affect discharge performance of the discharge units connected to the third channel and the fourth channel.

Means for Solving the Problem

A liquid discharge head according to the present invention includes: a plurality of discharge units each including a discharge hole, a pressurization chamber communicating with the discharge hole, a first channel for supply of liquid to the pressurization chamber, and a second channel for collection of liquid from the pressurization chamber; a pressurizing part for pressurizing the pressurization chamber; a third channel connected commonly to the first channels of the plurality of discharge units, the third channel for supply of liquid to the discharge units; a fourth channel connected commonly to the second channels of the plurality of discharge units, the fourth channel for collection of liquid from the discharge units; and a fifth channel connecting the discharge units to each other and having channel resistance larger than channel resistance of the first channel and the second channel.

A recording device according to the present invention includes the liquid discharge head, a conveyor configured to convey a recording medium to the liquid discharge head, and a controller configured to control the liquid discharge head.

Effect of the Invention

The liquid discharge head according to the present invention can reduce possibility that pressure from the discharge unit reaches the third channel and the fourth channel.

EMBODIMENTS FOR CARRYING OUT THE INVENTION

First Embodiment

Figure 1A:
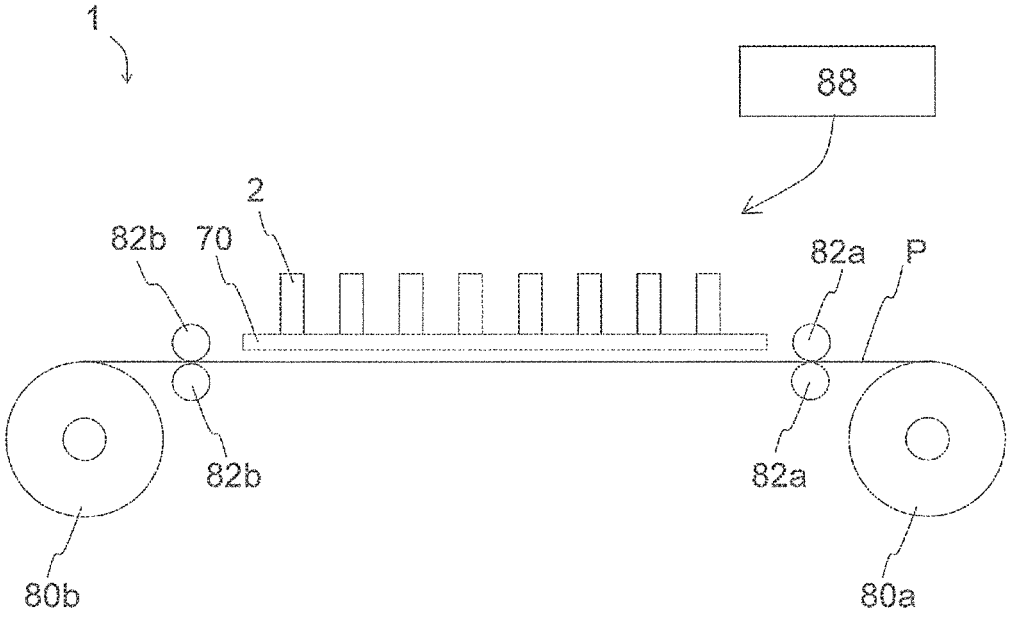
FIG. 1 (*a*) is a side view of a recording device including a liquid discharge head according to a first embodiment of the present invention, and FIG. 1(*b*) is a plan view thereof.
Figure 1B:
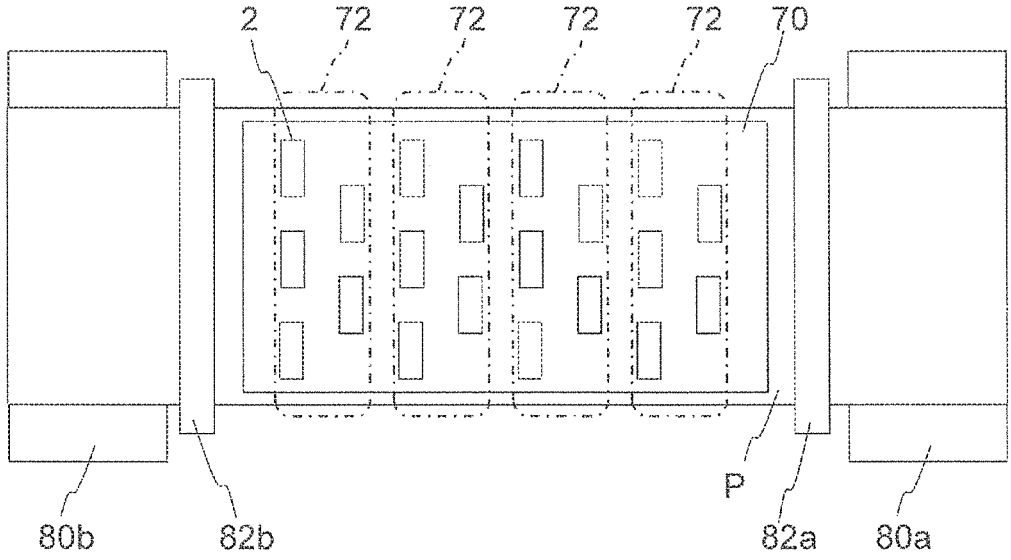

FIG. 1(*a*) is a schematic side view of a color ink jet printer (hereinafter, also simply called the printer) functioning as a recording device including a liquid discharge head 2 according to an embodiment of the present invention, and FIG. 1 (*b*) is a schematic plan view thereof. The printer 1 conveys printing paper P serving as a recording medium from a guide roller 82*a* to a convey roller 82*b* to shift the printing paper P relatively to the liquid discharge head 2. A controller 88 controls the liquid discharge head 2 in accordance with image data or character data to cause the liquid discharge head 2 to discharge liquid to the recording medium P and allow liquid droplets to reach the printing paper P for recording by means of printing or the like on the printing paper P.

The liquid discharge head 2 according to the present embodiment is fixed to the printer 1, which is a so-called line printer. A recording device according to a different embodiment of the present invention is exemplified by a so-called serial printer configured to alternately perform reciprocally shifting a liquid discharge head 2 in a direction crossing a direction of conveying a printing paper P, such as a direction substantially perpendicular thereto, and conveying the printing paper P.

The printer 1 includes a flat head mount frame 70 (hereinafter, also simply called the frame) disposed substantially in parallel with the printing paper P and fixed to the printer 1. The frame 70 is provided with twenty holes (not depicted), and twenty liquid discharge heads 2 are mounted at the holes, respectively. The liquid discharge heads 2 each have a portion that is configured to discharge liquid and faces the printing paper P. The liquid discharge heads 2 are distant from the printing paper P by about 0.5 to 20 mm or the like. Five liquid discharge heads 2 configure a single head group 72, and the printer 1 includes four head groups 72.

The liquid discharge heads 2 each have a rectangular shape extending from the front toward the back in FIG. 1(*a*), or in the vertical direction in FIG. 1(*b*). The extending direction will also be called a longitudinal direction. In each one of the head group 72, three of the liquid discharge heads 2 are aligned in a direction crossing the direction of conveying the printing paper P, for example, in a substantially perpendicular direction, whereas the remaining two liquid discharge heads 2 are displaced in the conveying direction to be aligned at positions between adjacent ones of the three liquid discharge heads 2. The liquid discharge heads 2 have printable ranges disposed continuously or disposed to have ends overlapped with each other in the width direction of the printing paper P (in a direction crossing the direction of conveying the printing paper P) to enable continuous printing in the width direction of the printing paper P.

The four head groups 72 are disposed in the direction of conveying the printing paper P. The liquid discharge heads 2 are each supplied with liquid such as ink from a liquid tank (not depicted). The liquid discharge heads 2 belonging to each one of the head groups 72 are supplied with an ink in one color, and the four head groups 72 enable printing in four colors. The head groups 72 discharge inks in magenta (M), yellow (Y), cyan (C), and black (K), for example. The controller 88 controls printing with these inks to enable printing a color image.

The printer 1 can be provided with only one liquid discharge head 2 in order for printing in one color in a range printable with the single liquid discharge head 2. The number of liquid discharge heads 2 included in each of the head groups 72 and the number of head groups 72 are variable appropriately in accordance with a printing target or a printing condition. For example, the number of head groups 72 can be increased for printing in more colors. Disposing a plurality of head groups 72 for printing in a single color and printing alternately in the conveying direction will achieve increase in conveying speed with use of the liquid discharge heads 2 of the same performance. This increases a printing area per unit time. Disposing a plurality of head groups 72 for printing in a single color to be displaced in a direction crossing the conveying direction will achieve higher resolution in the width direction of the printing paper P.

Instead of colored ink, liquid such as a coating agent can be printed for surface treatment of the printing paper P.

The printer 1 prints on the printing paper P serving as a recording medium. The printing paper P, which is wound around a paper feed roller 80*a*, passes between two guide rollers 82*a*, below the liquid discharge heads 2 mounted on the frame 70, between two convey rollers 82*b*, and is finally collected by a collect roller 80*b*. The convey rollers 82*b* are rotated to convey the printing paper P at constant speed and printing is performed with the liquid discharge heads 2. The collect roller 80*b* winds the printing paper P conveyed from the convey rollers 82*b*. The printing paper P is conveyed at a speed of 50 m/min or the like. The rollers can be controlled by the controller 88 or can be operated manually by a person.

Examples of the recording medium include, in addition to the printing paper P, wound cloth. The printer 1 can be configured to, instead of directly conveying the printing paper P, directly convey a conveyor belt provided thereon with the recording medium. Examples of the recording medium in such a configuration include a sheet of paper, cut cloth, wood, and tile. The liquid discharge head 2 can alternatively be configured to discharge liquid containing conductive particles for printing a wiring pattern of an electronic device. The liquid discharge head 2 can still alternatively be configured to discharge a predetermined amount of a liquid chemical agent or liquid containing a chemical agent to a reactor vessel or the like for reaction of producing a chemical product.

The printer 1 is optionally provided with a position sensor, a speed sensor, a temperature sensor, or the like, and the controller 88 controls each unit of the printer 1 in accordance with a status of the unit of the printer 1 based on information from the sensor. In a case where temperature of the liquid discharge head 2 or liquid in the liquid tank, pressure applied from the liquid in the liquid tank to the liquid discharge head 2, or the like influences a discharge property (e.g. a discharge amount or discharge speed) of the discharged liquid, a different driving signal for discharge of the liquid can be transmitted in accordance with the information.

Figure 5A:
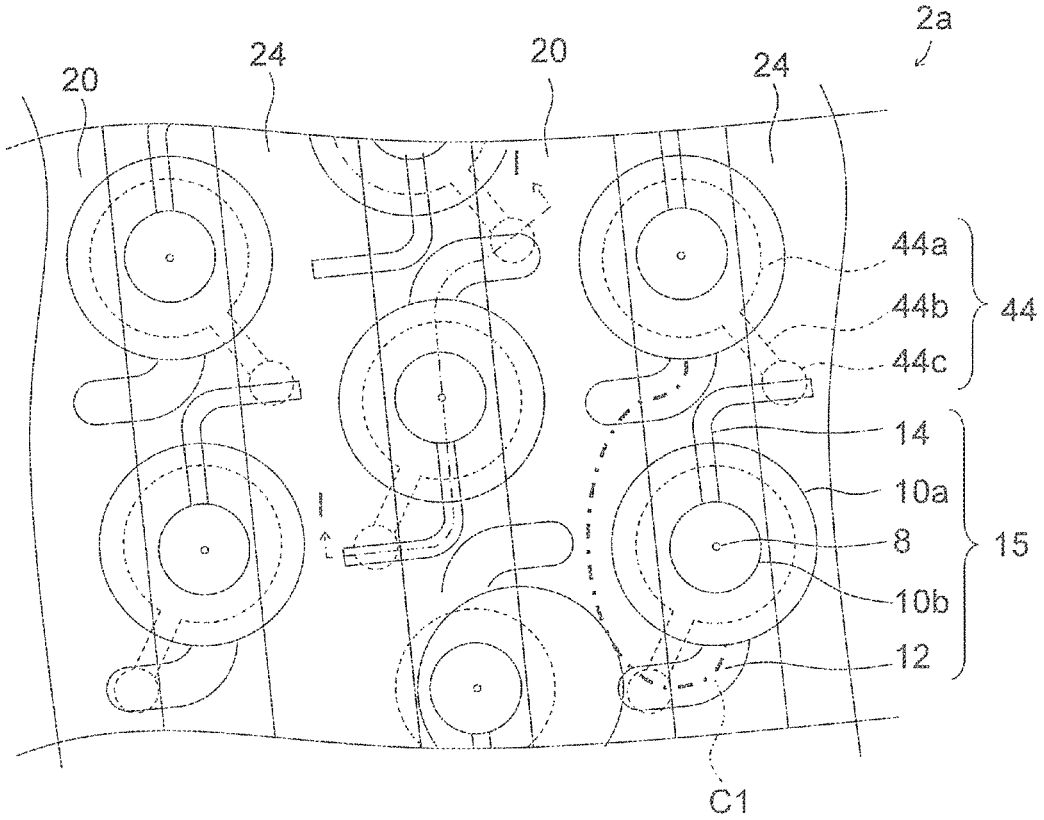
FIG. 5(*a*) is an enlarged plan view of part of the depiction in FIG. 3(*b*), and FIG. 5(*b*) is a sectional view taken along line I-I indicated in FIG. 5(*a*).
Figure 5B:
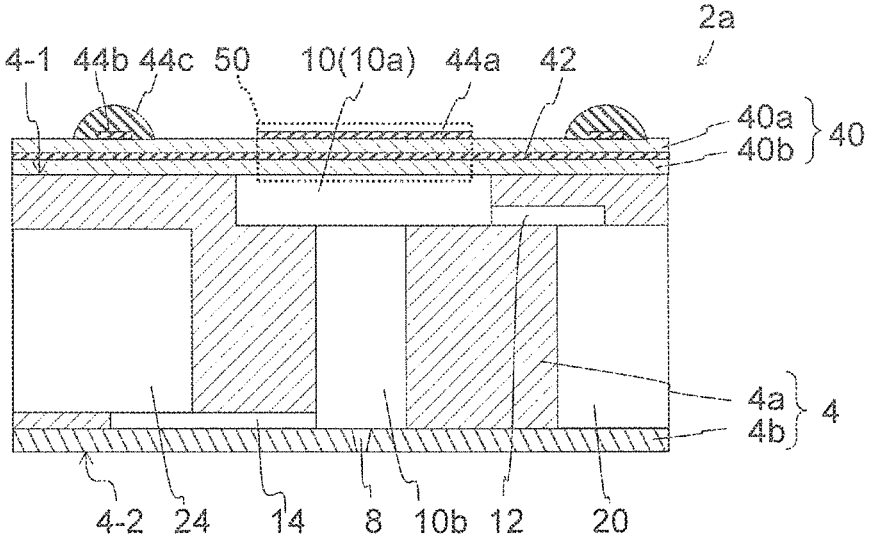

The liquid discharge head 2 according to an embodiment of the present invention will be described next with reference to FIGS. 2(*a*) to 6(*b*). FIGS. 3(*a*) to 6(*b*) depict channels and the like, which are disposed below and should be depicted with broken lines, with solid lines for more comprehensive depiction. The same applies to FIGS. 7 to 8(*b*). FIGS. 5(*a*) and 5(*b*) depict no coupling channel 17.

The liquid discharge head 2 can include, in addition to a head body 2*a*, a case made of a metal or a resin, a heat sink, a driver IC, a circuit board 90, and the like. The head body 2*a* has a function of discharging liquid in accordance with a signal transmitted from outside.

The circuit board 90 has a function of supplying the head body 2*a* with electric current and a function of transmitting a signal to the head body 2*a*, and can be configured by a flexible printed circuit (FPC) or the like. The circuit board 90 is electrically connected with an actuator substrate 40 and is extracted upward. The circuit board 90 extracted upward penetrates a through hole 6*a* provided in a primary channel member 6.

The head body 2*a* includes the primary channel member 6, a secondary channel member 4, and the actuator substrate 40. The actuator substrate 40 is provided on the secondary channel member 4, and the primary channel member 6 is provided on the secondary channel member 4 and surrounds the actuator substrate 40. The primary channel member 6 is not necessarily provided. Hereinafter, assume that a secondary supply channel 20 and a secondary collect channel 24 provided at the secondary channel member 4 extend in a first direction and the secondary supply channel 20 and the secondary collect channel 24 are aligned in a second direction.

The primary channel member 6 elongates in the second direction. The primary channel member 6 thus has a longitudinal direction parallel to the second direction. The primary channel member 6 has a function of supplying the secondary channel member 4 with externally supplied liquid. The secondary channel member 4 elongates in the second direction, and has various channels for discharge of the liquid supplied from the primary channel member 6 through a discharge hole 8. The actuator substrate 40 elongates in the second direction and includes a displacement element 50. The displacement element 50 has a function of individually pressurizing liquid in each pressurization chamber 10 provided at the secondary channel member 4.

The primary channel member 6 is provided therein with various channels and has a frame shape. The primary channel member 6 has a region that is not connected with the actuator substrate 40 but is joined to the secondary channel member 4, to surround the actuator substrate 40. This configuration inhibits discharged liquid from partially adhering as mist to the actuator substrate 40. The secondary channel member 4 is fixed by the primary channel member 6 at the outer periphery of the secondary channel member 4. This configuration inhibits the secondary channel member 4 from vibrating along with the driven displacement element 50 to cause sympathetic vibration or the like.

Figure 2A:
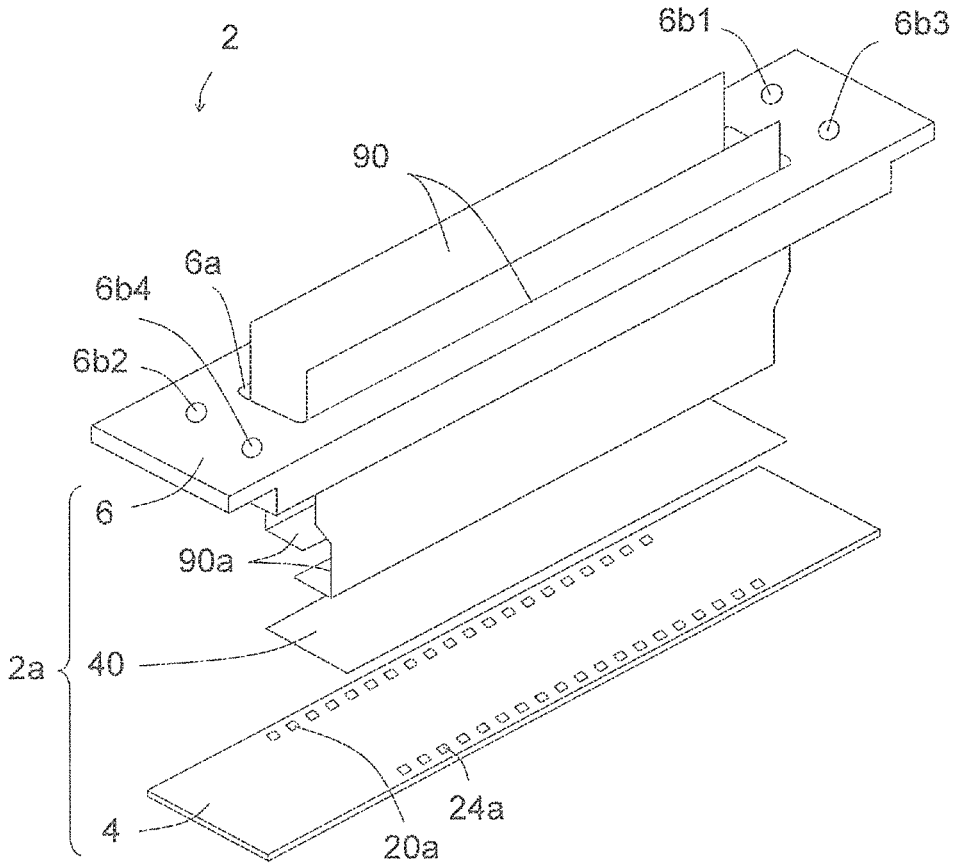
FIG. 2(*a*) is a perspective view of the liquid discharge head depicted in FIGS. 1(*a*) and 1(*b*), and FIG. 2(*b*) is a longitudinal sectional view thereof.
Figure 2B:
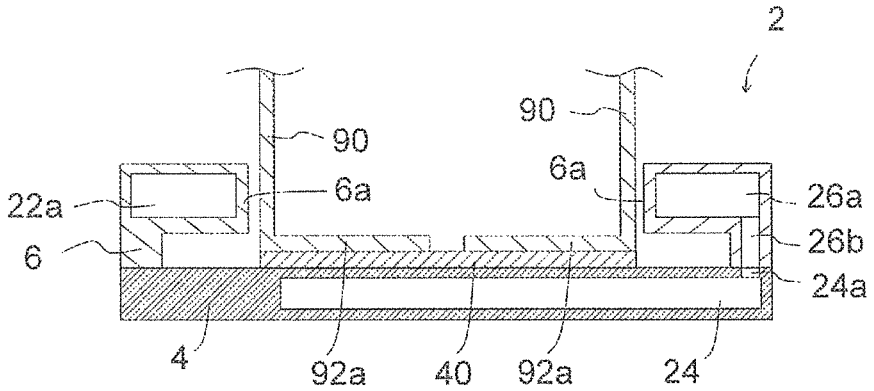
Figure 3A:
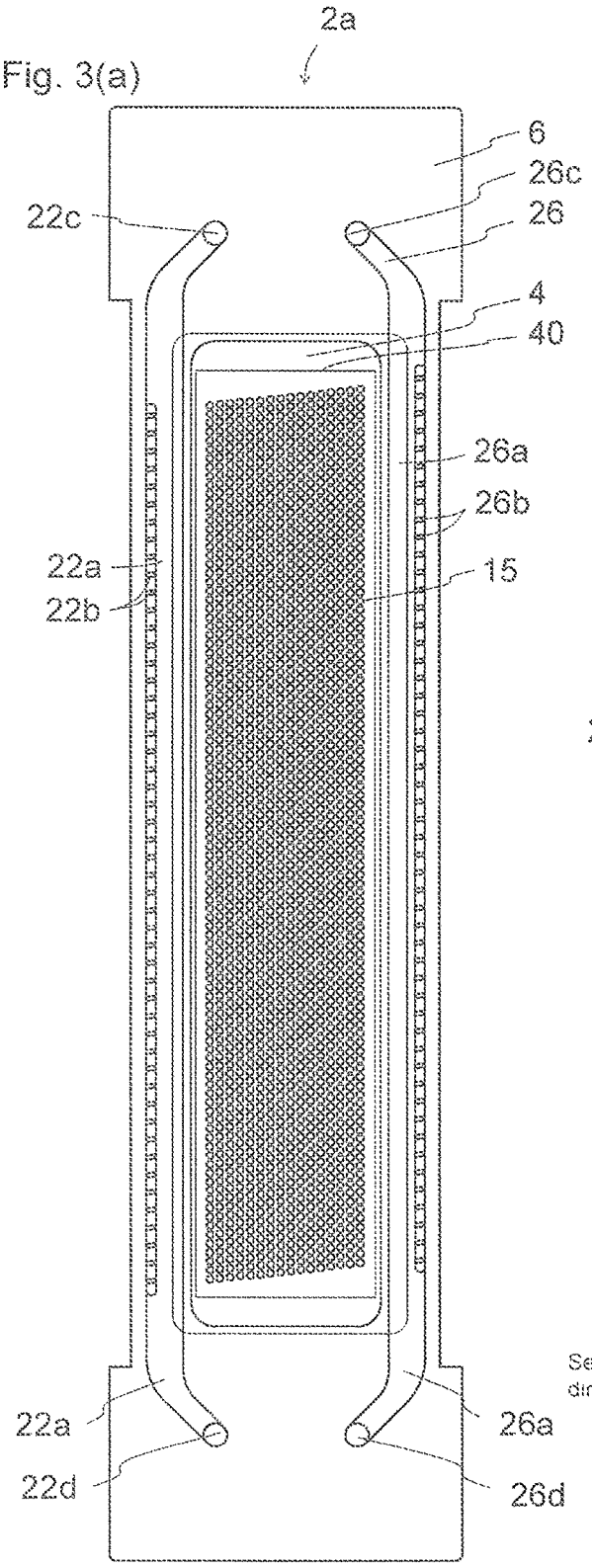
FIG. 3 (*a*) is a plan view of a head body included in the liquid discharge head depicted in FIGS. 1(*a*) and 1(*b*), and FIG. 3(*b*) is a plan view in a state where a primary channel member is removed.
Figure 3:
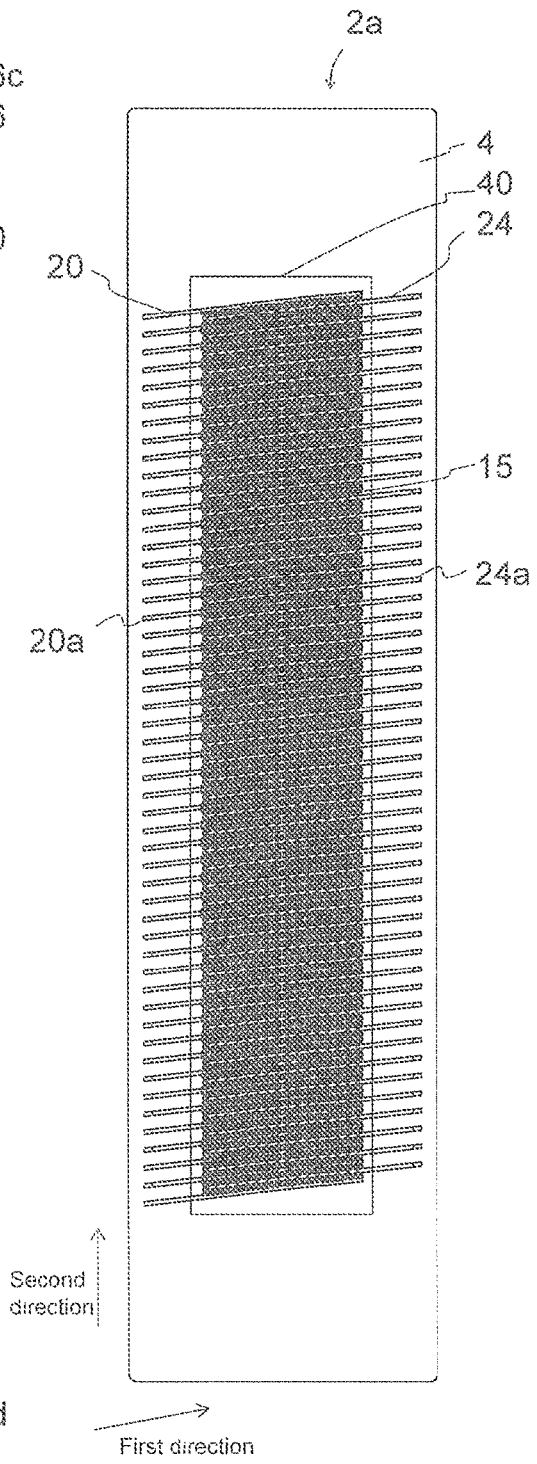

As depicted in FIG. 2(*a*), the primary channel member 6 has an opening 6*a* and through holes 6*b*1 to 6*b*4. The opening 6*a* is provided to allow the circuit board 90 to be extracted upward. The through holes 6*b*1 to 6*b*4 are connected with tubes via couplers or the like, and liquid is supplied to and drained from the primary channel member 6 through the through holes 6*b*1 to 6*b*4.

The primary channel member 6 includes a primary supply channel 22 and a primary collect channel 26. The primary supply channel 22 has a primary supply channel body 22*a*, a connection channel 22*b*, and openings 22*c* and 22*d*. The primary supply channel body 22*a* is provided in the second direction to be adjacent to a first side surface of the primary channel member 6, and has a function of supplying the secondary channel member 4 with externally supplied liquid. A plurality of connection channels 22*b* is arrayed in the second direction and has a function of individually supplying the secondary supply channel 20 of the secondary channel member 4 with liquid. The opening 22*c* communicates with the through hole 6*b*1 whereas the opening 22*d* communicates with the through hole 6*b*2.

The primary collect channel 26 has a primary collect channel body 26*a*, a connection channel 26*b*, and openings 26*c* and 26*d*. The primary collect channel body 26*a* is provided in the second direction to be adjacent to a second side surface of the primary channel member 6, and has a function of collecting liquid having flown at the secondary channel member 4. A plurality of connection channels 26*b* is arrayed in the second direction and has a function of individually collecting liquid from the secondary collect channel 24 of the secondary channel member 4. The opening 26*c* communicates with the through hole 6*b*3 whereas the opening 26*d* communicates with the through hole 6*b*4.

In order to supply liquid to the liquid discharge head 2 containing no liquid, the liquid is supplied from a first one of the openings (e.g. the opening 22*c*) to the primary channel member 6 so that the liquid in the primary supply channel 22 is likely to be drained to outside, and air and overflowed liquid are drained from a second one of the openings (e.g. the opening 22*d*) so that gas is unlikely to enter the secondary channel member 4. The primary collect channel 26 can similarly be configured to allow liquid to be supplied from a first one of the openings (e.g. the opening 26*c*) and to be drained from a second one of the openings (e.g. the opening 26*d*).

There are several methods of supplying and collecting liquid for printing. According to one of the methods, entire liquid supplied to the primary supply channel 22 enters the secondary channel member 4 and then the primary collect channel 26 and is drained to outside. The primary collect channel 26 is not supplied with external liquid in this case. Applicable to this case are a method of supplying liquid from the two openings 22*c* and 22*d* and collecting liquid from the two openings 26*c* and 26*d*, and a method of supplying liquid from a first one of the openings 22*c* and 22*d* with a second one being kept closed and collecting liquid from a first one of the openings 26*c* and 26*d* with a second one being kept closed. There are four methods in total as the openings to be used are selectable in each of the cases. Supplying liquid from two openings and collecting liquid from two openings are preferred for reduction in pressure difference due to a pressure loss. This may, however, complicate connection of the tubes for supply and drain of liquid and pressure control. Supplying liquid from one opening and collecting liquid from one opening achieve simplified connection and facilitated pressure control. In this case, liquid is preferably supplied and collected with paired openings opposite in the second direction for cancellation of pressure loss influence. Specifically, liquid can be supplied from the opening 22*c* and be collected from the opening 26*d*, or can be supplied from the opening 22*d* and be collected from the opening 26*c*.

There are still the following methods. Liquid is supplied from a first one of the openings (e.g. the opening 22*c*) of the primary supply channel 22 and is collected from a second one of the openings (e.g. the opening 22*d*), and liquid is supplied from a first one of the openings (e.g. the opening 26*d*) of the primary collect channel 26 and is collected from a second one of the openings (e.g. the opening 26*c*). When pressure of the primary supply channel 22 is made higher than pressure of the primary collect channel 26 by adjusting pressure of supplied liquid and pressure of drained liquid, liquid flows to the secondary channel member 4. This method minimizes differences of pressures applied to meniscuses of discharge holes 8 among the methods described above.

The above methods can be combined such that liquid is supplied to and drained from the primary supply channel 22 and is only collected from the primary collect channel 26. In contrast, liquid can be only supplied to the primary supply channel 22 and be supplied to and drained from the primary collect channel 26.

The above relations between supply and collection can be inverted. For example, liquid can be supplied from the opening 26*c* of the primary collect channel 26 with the opening 26*d* being closed and be collected from the opening 22*d* of the primary supply channel 22 with the opening 22*c* being closed.

The primary channel member 6 can be produced by stacking plates or the like provided with channel patterns. The primary channel member 6 can be 5 to 30 mm thick. The primary supply channel 22 and the primary collect channel 26 can each be provided with a damper for stable supply or drain of liquid regardless of variation in amount of discharged liquid. The primary supply channel 22 and the primary collect channel 26 can each be provided therein with a filter to allow less foreign matter or bubbles to enter the secondary channel member 4.

Such provision of the primary supply channel 22 and the primary collect channel 26 in the primary channel member 6 achieves increase in sectional area of the primary supply channel 22 and the primary collect channel 26. This reduces differences in pressure loss due to differences in position of connection between the primary supply channel 22 and the secondary supply channel 20 as well as in position of connection between the primary collect channel 26 and the secondary collect channel 24. The primary supply channel 22 and the primary collect channel 26 are thus preferred to have channel resistance not more than 1/100th of channel resistance of the secondary supply channel 20 and the secondary collect channel 24.

The secondary channel member 4 has a flat plate shape and is about 0.5 to 2 mm thick. The secondary channel member 4 includes a secondary channel member body 4*a* and a nozzle plate 4*b*, and can be produced by stacking metal plates or the like. The secondary channel member 4 has a pressurization chamber surface 4-1 provided with the pressurization chambers 10 planarly arrayed in a matrix form. The secondary channel member 4 has a discharge hole surface 4-2 provided with the liquid discharge holes 8 planarly arrayed in a matrix form. The discharge holes 8 communicate with the pressurization chambers 10.

The secondary channel member 4 includes a plurality of secondary supply channels 20, a plurality of secondary collect channels 24, a plurality of discharge units 15, and the coupling channel 17. The discharge units 15 are each disposed between the secondary supply channel 20 and the secondary collect channel 24 adjacent to each other. The discharge units 15 arrayed in the first direction are coupled by the coupling channel 17.

The discharge units 15 each include an individual supply channel 12, an individual collect channel 14, the discharge hole 8, and the pressurization chamber 10, and are provided at the secondary channel member 4. The present embodiment assume that the first channel corresponds to the individual supply channel 12, the second channel corresponds to the individual collect channel 14, the third channel corresponds to the secondary supply channel 20, the fourth channel corresponds to the secondary collect channel 24, and the fifth channel corresponds to the coupling channel 17.

The plurality of secondary supply channels 20 and the plurality of secondary collect channels 24 extend in the first direction. The secondary supply channels 20 and the secondary collect channels 24 are aligned alternately in the second direction crossing the first direction.

The secondary supply channels 20 and the secondary collect channels 24 are disposed alternately to achieve excellent area efficiency, increase in the number of the discharge units 15 for higher resolution, increase in thickness of the secondary supply channels 20 and the secondary collect channels 24 for lower channel resistance, decrease in discharge property difference of the discharge units 15, and reduction in planar size of the head body 2*a*.

The discharge units 15 configure discharge unit rows 9*a* and 9*b* in the first direction each between the secondary supply channel 20 and the secondary collect channel 24. Each of the discharge units 15 is pressurized by the deformed displacement element 50 above the discharge unit 15 to discharge liquid from the discharge hole 8.

Figure 4:
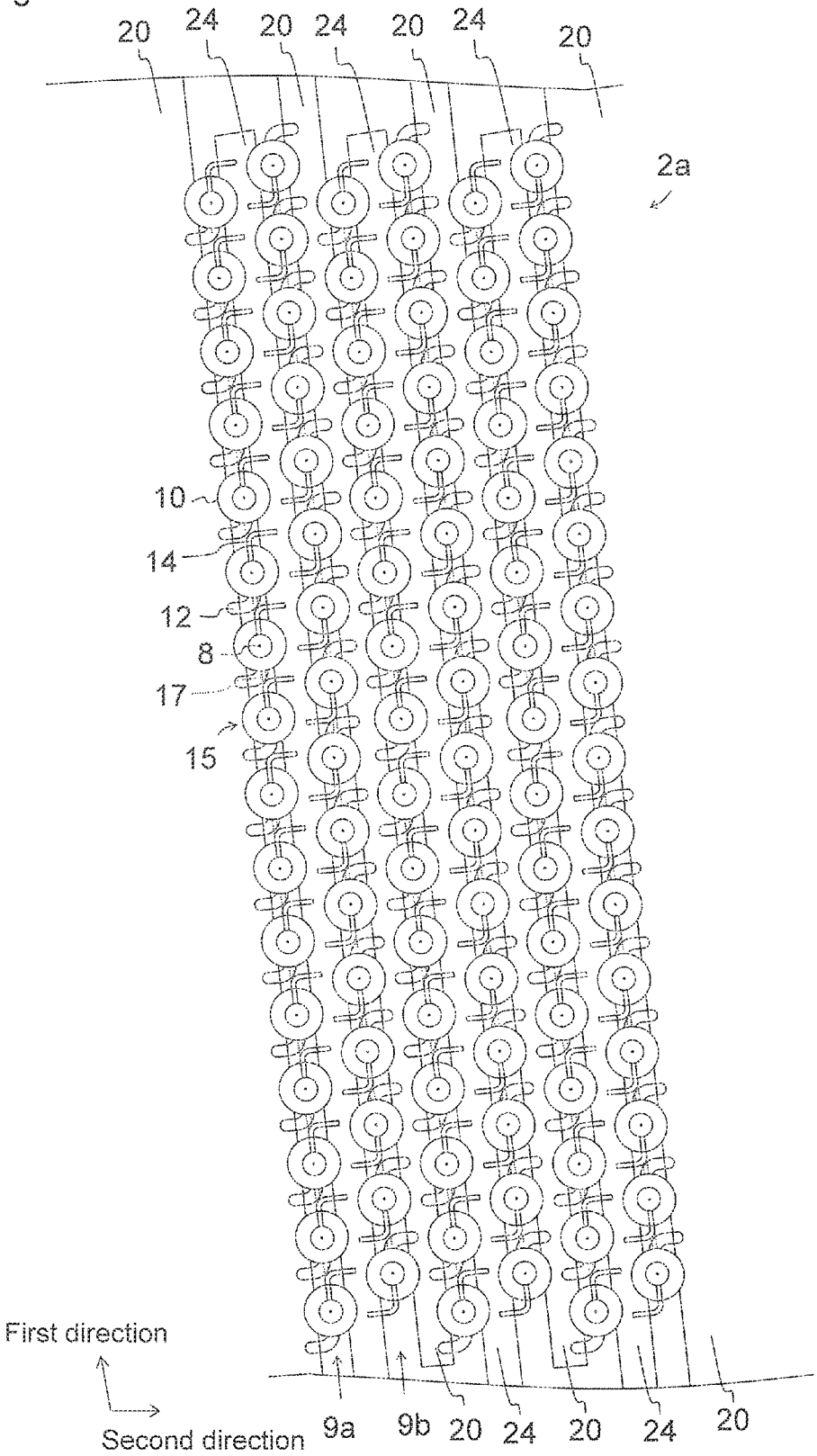
FIG. 4 is an enlarged plan view of part of the depiction in FIG. 3 (*b*).

As depicted in FIG. 4, the discharge unit rows 9*a* and 9*b* each include 16 discharge units 15. In the discharge units 15 belonging to the discharge unit rows 9*a* and 9*b*, the discharge holes 8 projected in a direction perpendicular to the second direction have equal intervals. The discharge holes 8 of the discharge units 15 belonging to the discharge unit row 9*a* are projected between the discharge holes 8 of the discharge units 15 belonging to the discharge unit row 9*b*. The discharge holes 8 in such a configuration are arrayed at an interval of 360 dpi in a direction perpendicular to the second direction. This configuration achieves printing of the resolution of 360 dpi on the printing paper P conveyed in the second direction.

The discharge unit rows 9*a* and 9*b* are disposed alternately in the second direction. Specifically, the secondary supply channels 20 and the secondary collect channels 24 are each interposed between the discharge unit rows 9*a* and 9*b*.

The discharge unit rows 9*a* and 9*b* are displaced from each other in the first direction. Specifically, the discharge unit rows 9*b* are disposed closer to the primary supply channel 22 than the discharge unit rows 9*a*. The discharge units 15 are thus disposed in a zigzag form. This increases the distance between the adjacent discharge units 15.

The secondary supply channels 20 each have an opening 20*a* provided close to the primary supply channel 22 in the first direction. The secondary collect channels 24 each have an opening 24*a* provided close to the primary collect channel 26 in the first direction. This reduces differences in flow rate of liquid due to disposed positions of the discharge units 15. The openings 20*a* of the secondary supply channels 20 as well as the openings 24*a* of the secondary collect channels 24 are opened to the pressurization chamber surface 4-1.

The discharge units 15 will be described below. Each of the discharge units 15 includes one individual supply channel 12, one individual collect channel 14, one discharge hole 8, and one pressurization chamber 10. The discharge unit 15 alternatively includes a plurality of individual supply channels 12 or a plurality of individual collect channels 14. The individual supply channel 12 is connected to the secondary supply channel 20 adjacent to the discharge unit 15, whereas the individual collect channel 14 is connected to the secondary collect channel 24 adjacent to the discharge unit 15. Liquid supplied from the individual supply channel 12 is thus partially discharged from the discharge hole 8, with the remaining liquid is collected through the individual collect channel 14. The discharge units 15 configuring one discharge unit row 9*a* are connected by the coupling channel 17. The discharge units 15 configuring one discharge unit row 9*b* are similarly connected by a different coupling channel 17.

Each of the pressurization chambers 10 includes a pressurization chamber body 10*a* and a partial channel 10*b*. The pressurization chamber 10 is provided therebelow with the discharge hole 8. The discharge hole 8 is provided for each of the pressurization chambers 10, and the pressurization chamber body 10*a* and the discharge hole 8 are connected with each other via the partial channel 10*b*. The discharge hole 8 is shaped to be reduced in planar area toward the discharge hole surface 4-2.

The pressurization chamber 10 is connected with the individual supply channel 12 and the individual collect channel 14. The individual supply channel 12 is connected to the pressurization chamber body 10*a* whereas the individual collect channel 14 is connected to the partial channel 10*b*.

At the discharge unit 15, liquid supplied from the secondary supply channel 20 flows into the individual supply channel 12, is pressurized in the pressurization chamber body 10*a*, and is delivered to the partial channel 10*b*. The liquid delivered to the partial channel 10*b* is partially discharged from the discharge hole 8 and applied to the recording medium P.

The partial liquid not discharged from the discharge hole 8 flows into the individual collect channel 14, passes through the individual collect channel 14, and flows out to the secondary collect channel 24. Liquid collected from the discharge units 15 and passing through the secondary collect channel 24 flows into the primary collect channel 26 to be collected.

The actuator substrate 40 including the displacement element 50 is joined to the upper surface of the secondary channel member 4, and the displacement element 50 is disposed on each of the pressurization chambers 10. The actuator substrate 40 occupies a region in a substantially same shape as those of a pressurization chamber group including the pressurization chambers 10. The pressurization chambers 10 each have an opening closed by the actuator substrate 40 joined to the pressurization chamber surface 4-1 of the channel member 4.

The actuator substrate 40 has a rectangular shape elongating in the second direction similarly to the head body 2*a*. The actuator substrate 40 is electrically connected with the circuit board 90 configured to supply each of the displacement elements 50 with a signal.

The actuator substrate 40 includes piezoelectric ceramics layers 40*a* and 40*b*, a common electrode 42, and an individual electrode 44.

The actuator substrate 40 is formed by stacking the piezoelectric ceramics layer 40*b*, the common electrode 42, the piezoelectric ceramics layer 40*a*, and the individual electrode 44. The common electrode 42 and the individual electrode 44 face each other with the piezoelectric ceramics layer 40*a* being interposed therebetween form a region functioning as the displacement element 50. The piezoelectric ceramics layer 40*b* functions as a vibration plate.

These piezoelectric ceramics layers 40*a* and 40*b* are made of a ceramics material of a lead zirconate titanate (PZT) system, a $NaNbO_3$ system, a $BaTiO_3$ system, a $(BiNa)NbO_3$ system, a $BiNaNb_5O_{15}$ system, or the like having ferroelectricity. The piezoelectric ceramics layer 40*b* is not necessarily made of a piezoelectric material, but can be a different ceramics layer or a metal plate not made of any piezoelectric material.

The common electrode 42 is provided between the piezoelectric ceramics layer 40*a* and the piezoelectric ceramics layer 40*b* and expands in the entire region provided with the piezoelectric ceramics layers 40*a* and 40*b*. The common electrode 42 is made of a metal material of an Ag—Pd system or the like and is about 2 μm thick. There is provided a via hole (not depicted) that penetrates the piezoelectric ceramics layer 40*a* and is electrically connected with a surface electrode for the common electrode provided on a surface of the piezoelectric ceramics layer 40*a*.

The individual electrode 44 has an individual electrode body 44*a*, an extraction electrode 44*b*, and a connection electrode 44*c*. The individual electrode body 44*a* and the extraction electrode 44*b* are made of a metal material of an Au system or the like and is about 1 μm thick. The connection electrode 44*c* is made of a conductive resin containing conductive particles such as silver particles, and is about 5 to 200 μm thick. The individual electrode body 44*a* is disposed on the pressurization chamber 10 to correspond to the pressurization chamber 10. Pressure is applied to a gap between the individual electrode body 44*a* and the common electrode 42 to displace the displacement element 50.

The extraction electrode 44*b* is extracted from the individual electrode body 44*a* to outside the pressurization chamber 10. The connection electrode 44*c* is provided on the extraction electrode 44*b* in a portion extracted to outside a region facing the pressurization chamber 10. The connection electrode 44*c* is electrically joined to wiring of the circuit board 90.

Figure 6A:
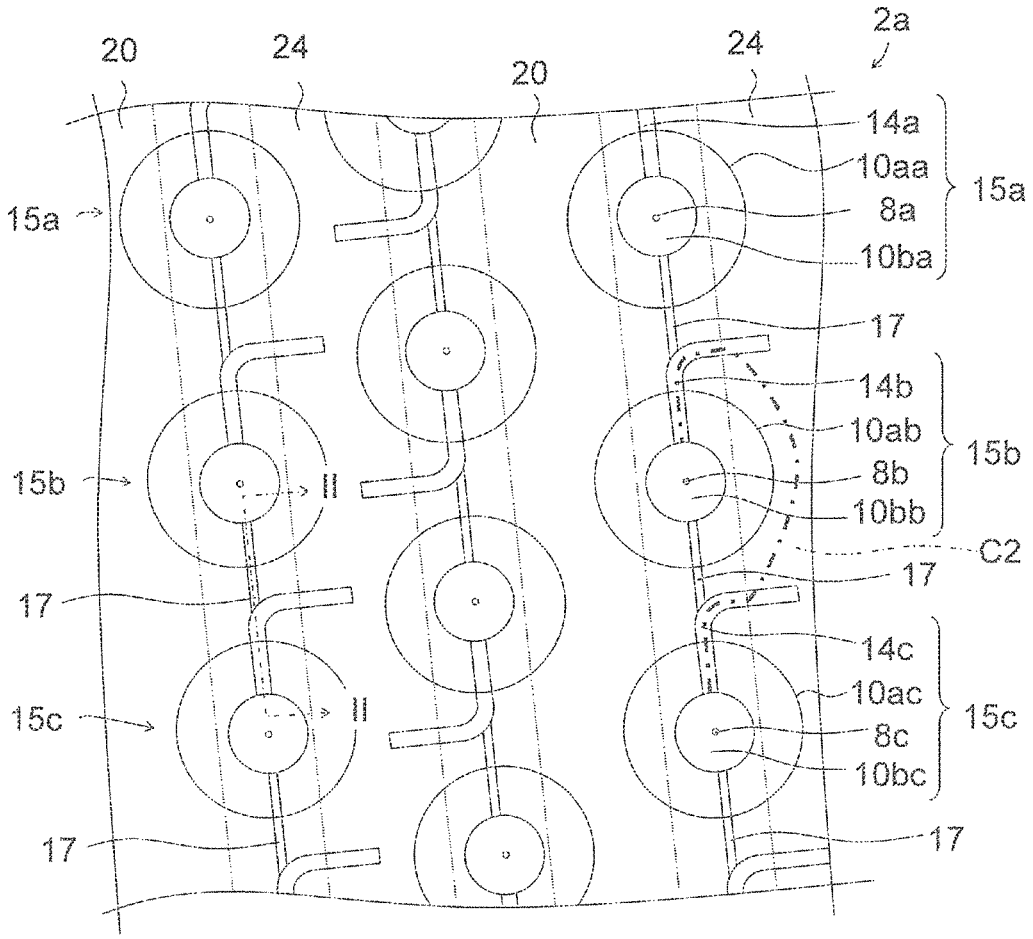
FIG. 6(*a*) is an enlarged plan view of part of the depiction in FIG. 4 (*b*) including neither an individual electrode nor an individual supply channel, and FIG. 6(*b*) is a sectional view taken along line II-II indicated in FIG. 6(*a*).
Figure 6B:
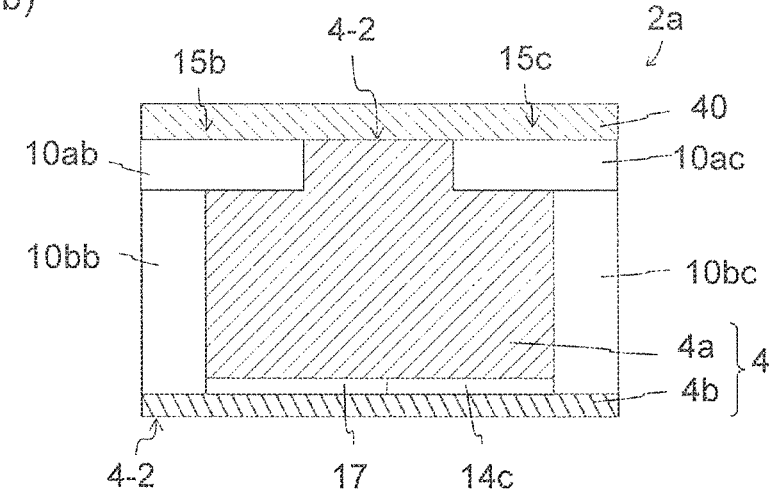

The coupling channel 17 connects the discharge units 15 as depicted in FIGS. 4, 6(*a*), and 6 (*b*), and extends in the first direction. More specifically, the coupling channel 17 connects the discharge units 15 included in each of the discharge unit rows 9*a* and 9*b*.

The coupling channel 17 connects the partial channel 10*bb* of a discharge unit 15*b* and an individual collect channel 14*c* of a discharge unit 15*c*. The coupling channel 17 has channel resistance larger than that of individual supply channels 12*b* and 12*c* of the discharge units 15*b* and 15*c*, and channel resistance of individual collect channels 14*b* and 14*c*. Out of the channels connecting the discharge unit 15*b* and the discharge unit 15*c*, the channel including the coupling channel 17 has channel resistance larger than channel resistance of the channel not including the coupling channel 17. More specifically, the channel including the coupling channel 17 and part of the individual collect channel 14*b* and connecting the discharge unit 15*b* and the discharge unit 15*c* has channel resistance larger than channel resistance of a channel C1 depicted in FIG. 5(*a*) and channel resistance of a channel C2 depicted in FIG. 6 (*a*). The channel C1 includes one individual supply channel 12, part of the secondary supply channel 20 leading to the next discharge unit 15 connected with the coupling channel 17, and another individual supply channel 12. The channel C2 includes one individual collect channel 14, part of the secondary collect channel 24 leading to the next discharge unit 15 connected with the coupling channel 17, and another individual collect channel 14.

Pressure generated in the pressurization chamber 10 by pressurization of the actuator substrate 40 may partially be transmitted to the individual supply channel 12 and the individual collect channel 14 communicating with the pressurization chamber 10. In this case, the pressure may reach the secondary supply channel 20 and the secondary collect channel 24 commonly connected to the discharge units 15 through the individual supply channel 12 and the individual collect channel 14 to adversely affect discharge performance of the discharge units 15 connected to the secondary supply channel 20 and the secondary collect channel 24.

Conceived for reduction of such influence is a structure including another channel connected to the discharge unit 15. Pressure of the discharge unit 15 is partially transmitted to the channel, so that less pressure will be transmitted to the secondary supply channel 20 and the secondary collect channel 24. In order for less influence of pressure to a peripheral channel, the additional channel is desired to have a dead end with no connection with the peripheral channel. Even in a case where the channel has the dead end, it is difficult to keep the portion in use filled with liquid. Liquid may be filled successfully after the entire head body 2*a* is placed in vacuo, while it is more difficult to drain the liquid once filled. The filled liquid may deteriorate in a long period of time. Furthermore, such liquid difficult to be drained cannot be discharged to be replaced with different liquid.

The channel to be connected with the discharge unit 15 does not have any dead end but is the coupling channel 17 connected with an adjacent discharge unit 15. The coupling channel 17 connects the discharge units 15 and thus has pressure to be transmitted therethrough, although the pressure has little influence due to large channel resistance of the coupling channel 17. Influence of decreasing pressure transmitted through the individual supply channel 12 and the individual collect channel 14 is thus larger than influence of increasing pressure transmitted through the coupling channel 17, to reduce influence of transmitting pressure generated in the pressurization chamber 10.

The coupling channel 17 has channel resistance larger than channel resistance of individual supply channels 12*a* and 12*b* of discharge units 15*a* and 15*b* and channel resistance of individual collect channels 14*a* and 14*b*. Pressure transmitted to the coupling channel 17 is thus attenuated while passing through the coupling channel 17. This reduces possibility of transmission of pressure generated at the discharge unit 15*a* to the discharge unit 15*b* through the coupling channel 17.

There is preferably provided a damper facing the coupling channel 17 for more attenuation of pressure transmitted through the coupling channel 17. The damper is provided as a deformed wall surface of a channel for change in volume of the channel. Such a damper thus provided is deformed to reduce change in pressure of liquid in the coupling channel 17. The coupling channel 17 has a portion that is close to the discharge hole surface 4-2 and faces the nozzle plate 4*b*, and the opposite surface of the nozzle plate 4*b* not facing the coupling channel 17 is provided with an external space. The nozzle plate 4*b* facing the coupling channel 17 thus serves as a damper to be deformed by warping to change the volume of the coupling channel 17. Thickness of the damper or the nozzle plate 4*b* is preferred to be not more than the width of the coupling channel 17 for better damper efficiency, is more preferred to be not more than a half the width of the coupling channel 17, and is particularly preferred to be not more than one fourth of the width of the coupling channel 17. In a case where the coupling channel 17 is 180 μm in width, the thickness of the nozzle plate 4*b* is preferably not more than 180 μm, more preferably not more than 90 μm, and particularly not more than 45 μm.

The coupling channel 17 connects the discharge units 15 and is connected with neither the secondary supply channel 20 nor the secondary collect channel 24. This configuration prevents pressure transmission to the secondary supply channel 20 and the secondary collect channel 24 when pressure is transmitted to the coupling channel 17. The coupling channel 17 has ends connected with the discharge units 15 and has no dead end. The coupling channel reduces possibility of liquid retention, difficult liquid introduction, and difficult liquid drainage due to provision of such a dead end.

In the head body 2*a*, the secondary supply channels 20 and the secondary collect channels 24 extend in the first direction and the coupling channel 17 extends in the first direction. The coupling channel 17 can thus be provided at a partition portion between the secondary supply channel 20 and the secondary collect channel 24 in the secondary channel member 4. This enables efficient use of an internal space of the secondary channel member 4.

In a case where the coupling channel 17 connected to the discharge unit 15*a* is not connected to the different discharge unit 15*b*, the coupling channel 17 will have an end provided with a closed space. In this case, bubbles may be generated in the closed space when the head body 2*a* is filled with liquid.

The coupling channel 17 actually connects the discharge units 15, so that the respective ends of the coupling channel 17 are connected to the discharge units 15. The ends of the coupling channel 17 having no closed space thus reduce possibility of bubble generation even when the head body 2*a* is filed with liquid.

The plurality of discharge units 15 is arrayed in the first direction and the coupling channel 17 connects the at least three continuous discharge units 15*a* to 15*c* adjacent to one another in the first direction. In other words, the discharge units 15 configure the discharge unit row 9*a*, and the continuous discharge units 15 in the discharge unit row 9*a* are connected by the coupling channel 17.

The discharge units 15 in the discharge unit row 9*a* thus communicate commonly. Each of the discharge units 15 is thus filled with liquid when the head body 2*a* is filled with liquid with less possibility of bubble generation in the head body 2*a*.

All the discharge units 15 in the discharge unit row 9*a* are not necessarily connected by a single coupling channel 17. For example, a half of the discharge units 15 in the discharge unit row 9*a* can be connected by each one of two coupling channels 17. Specifically, the discharge unit row 9*a* can be provided with the coupling channel 17 connecting the discharge units 15 in first to eighth lines and the coupling channel 17 connecting the discharge units 15 in ninth to sixteenth lines.

The coupling channel 17 has one end connected to the individual collect channel 14. Even in a case where pressure is transmitted to the individual collect channel 14, the pressure in the individual collect channel 14 can thus be transmitted to the coupling channel 17 with less possibility of pressure transmission to the secondary collect channel 24.

The individual collect channel 14 extends in the first direction and is then bent into a direction perpendicular to the first direction. The coupling channel 17 is connected to the bent portion of the individual collect channel 14 and extends in the first direction. This configuration achieves efficient transmission, to the coupling channel 17, pressure transmitted from the pressurization chamber 10 through the individual collect channel 14 in the first direction.

The coupling channel 17 has the other end connected to the partial channel 10*b*. This reduces possibility of pressure transmission to the individual collect channel 14 connected to the partial channel 10*b*.

Particularly because pressure is transmitted from the pressurization chamber toward the discharge hole 8 for discharge of liquid, one end of the coupling channel 17 is connected to the individual collect channel 14 and the other end of the coupling channel 17 is connected to the partial channel 10*b* to effectively inhibit pressure transmission to the secondary collect channel 24.

One end of the coupling channel 17 is alternatively connected to the individual supply channel 12. Even in a case where pressure is transmitted to the individual supply channel 12, the pressure in the individual supply channel 12 can thus be transmitted to the coupling channel 17 with less possibility of pressure transmission to the secondary supply channel 20.

Second Embodiment

Figure 7:
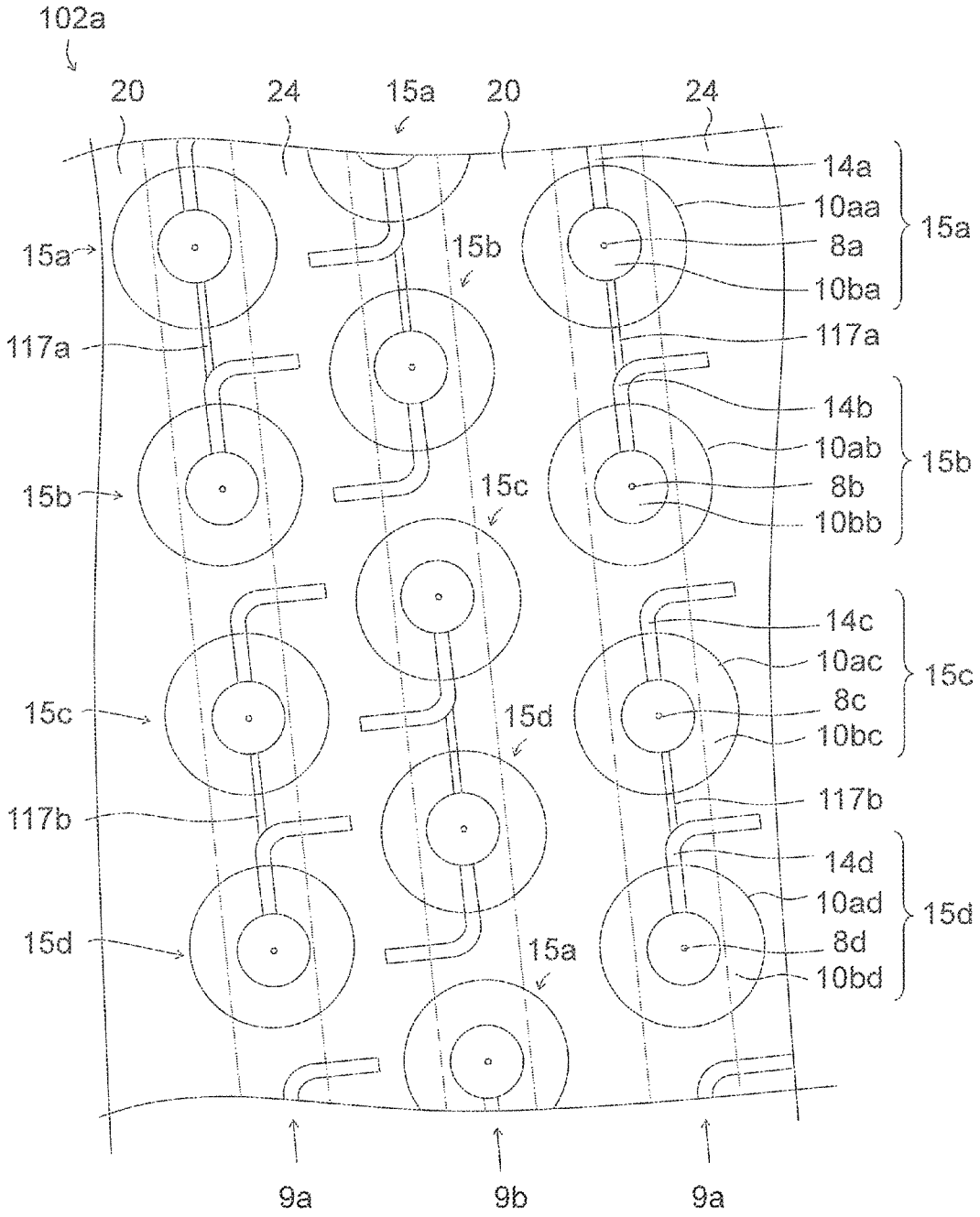
FIG. 7 is an enlarged plan view corresponding to FIG. 6(*a*), depicting a head body included in a liquid discharge head according to a second embodiment.

A head body 102*a* of a liquid discharge head 102 will be described with reference to FIG. 7. The head body 102*a* is different from the head body 2*a* in the shape of a coupling channel 117, while the remaining portions are identical and will not be described repeatedly. Identical members will be denoted by identical reference numerals. The same applies hereinafter.

A coupling channel 117*a* connects one of the discharge units 15*a* to 15*c*, namely, the discharge unit 15*b*, and one of the two discharge units 15*a* and 15*c* adjacent in the first direction to the discharge unit 15*b*, namely, the discharge unit 15*a*.

More specifically, the discharge unit rows 9*a* and 9*b* include discharge units 15*a* to 15*d*. The coupling channel 117*a* connects a partial channel 10*ba* of the discharge unit 15*a* and the individual collect channel 14*b* of the discharge unit 15*b*. A coupling channel 117*b* connects a partial channel 10*bc* of the discharge unit 15*c* and an individual collect channel 14*d* of the discharge unit 15*d*.

Specifically, the discharge unit 15*b* is connected with only one of the adjacent discharge unit 15*a* and 15*c* via the coupling channel 117*a*. In other words, there is a plurality of coupling channels 117*a* connecting the discharge units 15*a* and 15*b*.

This configuration achieves reduction in volume of the coupling channels 117 in the secondary channel member 4 and inhibits deterioration in rigidity of the secondary channel member 4. Furthermore, when the secondary channel member 4 is produced by stacking a plurality of thin metal plates, the configuration inhibits deterioration in handleability of the metal plates.

Third Embodiment

Figure 8A:
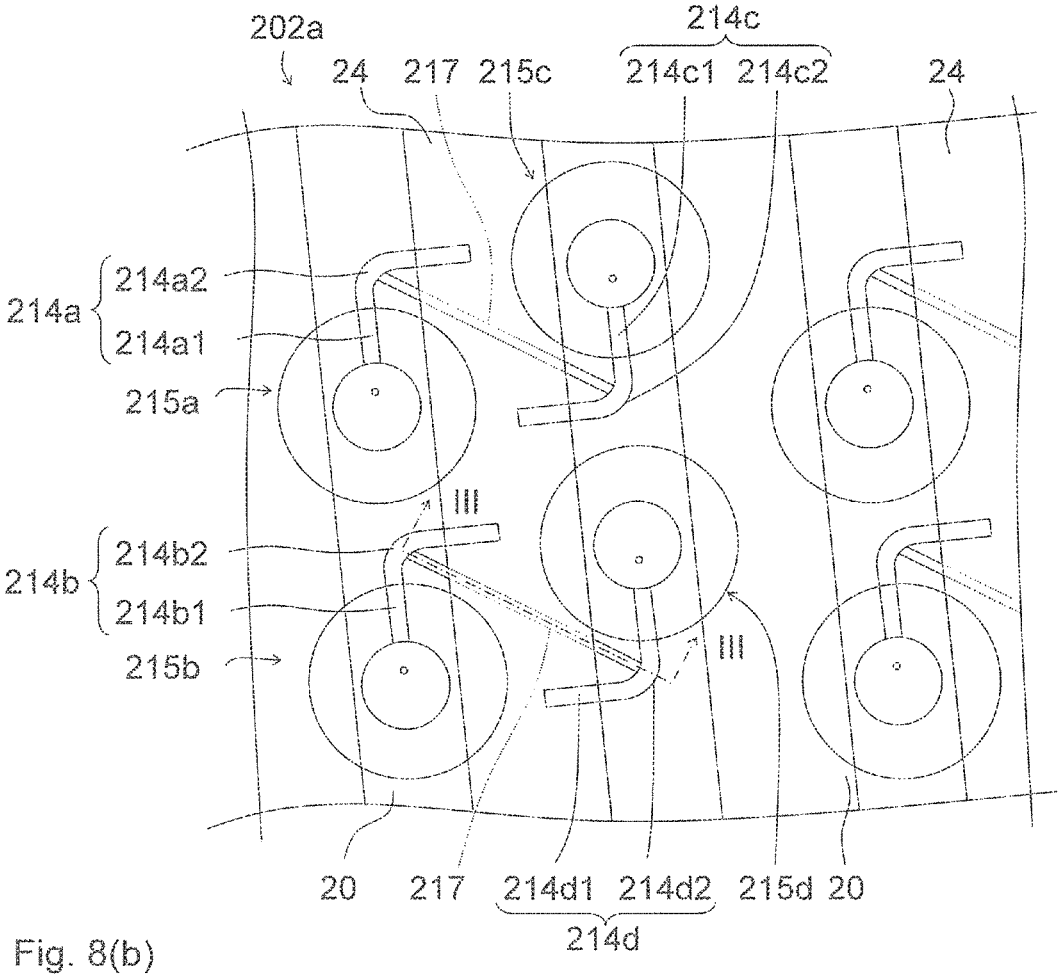
FIG. 8 (*a*) is an enlarged plan view corresponding to FIG. 6(*a*), depicting a head body included in a liquid discharge head according to a third embodiment, and FIG. 8 (*b*) is a sectional view thereof taken along line III-III.
Figure 8B:
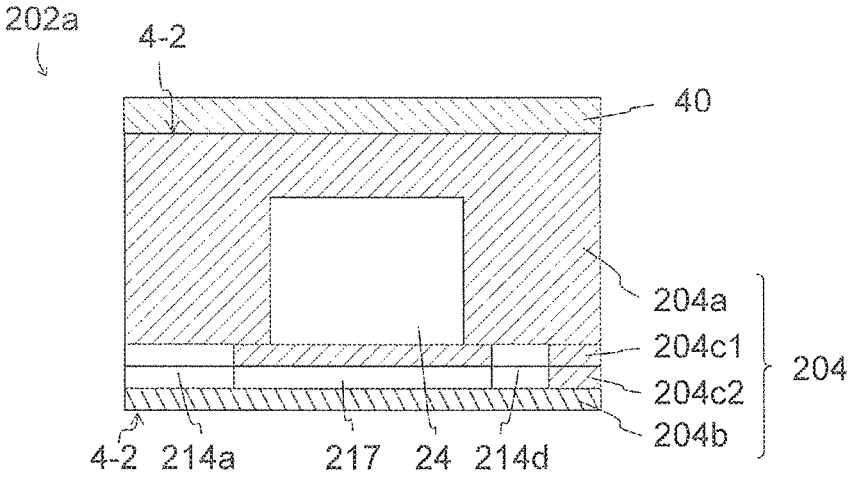

Ahead body 202*a* will be described with reference to FIGS. 8(*a*) and 8(*b*). The head body 202*a* includes a secondary channel member 204 different in structure from the secondary channel member 4.

The secondary channel member 204 includes a secondary channel member body 204*a*, a nozzle plate 204*b*, a first collect plate 204*c*1, and a second collect plate 204*c*2. The secondary channel member body 204*a* and the nozzle plate 204*b* are similar to the secondary channel member body 4*a* and the nozzle plate 4*b* and will thus not be described repeatedly.

The first collect plate 204*c*1 and the second collect plate 204*c*2 are disposed between the secondary channel member body 204*a* and the nozzle plate 204*b*. The first collect plate 204*c*1 is provided with an individual collect channel 214. The second collect plate 204*c*2 is provided with the individual collect channel 214 and a coupling channel 217. The first collect plate 204*c*1 is thus interposed between the coupling channel 217 and the secondary collect channel 24, and the coupling channel 217 not communicating with the secondary collect channel 24 is positioned below the secondary collect channel 24.

Assume that a third direction is perpendicular to the first direction and the second direction. The discharge unit 15 is provided, on one side in the third direction, with the displacement element 50 functioning as a pressurizing part, and the pressurization chamber body 10*a* directly pressurized by the displacement element 50. The discharge unit 15 is provided, on the other side in the third direction, with the discharge hole 8.

Liquid is thus preferred to be supplied to and drained from the discharge unit 15 such that liquid is supplied to the pressurization chamber body 10*a* on one side in the third direction of the discharge unit 15 and is collected from the partial channel 10*b* on the other side in the third direction of the discharge unit 15. Specifically, the discharge unit 15 and the secondary supply channel 20 are preferably connected on one side in the third direction of the discharge unit 15, and the discharge unit 15 and the secondary collect channel 24 are preferably connected on the other side in the third direction of the discharge unit 15. In a case where the discharge units 15 are connected with each other at a position adjacent to the collected liquid, the coupling channel 217 is preferably connected on the collect sides of the discharge unit 15, i.e. on the other sides in the third direction. In this case, space utilization efficiency is improved by disposing the coupling channel 217 on the other side in the third direction from the secondary collect channel 24. By disposing the coupling channel 217 so as to be partially overlapped with the secondary collect channel 24 in a view in the third direction, the discharge units 15 can be connected with each other via the coupling channel 217 of no complex layout.

A coupling channel 217 connects a discharge unit 215*a* and a discharge unit 215*c*. Another coupling channel 217 connects a discharge unit 215*b* and a discharge unit 215*d*. Each of the coupling channels 217 thus connects the discharge units 215 provided with the secondary collect channel 24 being interposed therebetween.

This configuration increases the length of the coupling channel 217. Pressure transmitted in the coupling channel 217 can thus be attenuated while passing through the coupling channel 217, with less possibility of pressure transmission to the discharge unit connected via the coupling channel 217.

An individual collect channel 214*a* includes an extracted portion 214*a*1 and a bent portion 214*a*2. The extracted portion 214*a*1 is extracted in the first direction, and the individual collect channel 214 is bent at the bent portion 214*a*2 from the first direction to the second direction.

The coupling channel 217 connects the bent portion 214*a*2 of the individual collect channel 214*a* and a bent portion 214*c*2 of an individual collect channel 214*c*. The other coupling channel 217 connects a bent portion 214*b*2 of an individual collect channel 214*b* and a bent portion 214*d*2 of an individual collect channel 214*d*. The coupling channel 217 thus transmits, to the individual collect channel 214*c*, pressure transmitted to the individual collect channel 214*a* while attenuating the pressure inside the coupling channel 217. Even in a case where pressure is not sufficiently attenuated in the coupling channel 217, this configuration reduces possibility of pressure transmission to the secondary collect channel 24.

The coupling channel 217 is optionally provided with an intermediate enlarged portion having larger channel resistance. When pressure passing through the coupling channel 217 reaches the enlarged portion, pressure is unlikely to be released from the enlarged portion to further inhibit possibility of pressure passage in the coupling channel 217.

In another case where the discharge units 15 are connected with each other at a position adjacent to the supplied liquid, the coupling channel 217 is preferably connected on the supply sides of the discharge unit 15*s*, i.e. on one sides in the third direction. In this case, space utilization efficiency is improved by disposing the coupling channel 217 on one side in the third direction from the secondary supply channel 20. By disposing the coupling channel 217 so as to be partially overlapped with the secondary supply channel 20 in a view in the third direction, the discharge units 15 can be connected with each other via the coupling channel 217 of no complex layout. In this case, the coupling channel 217 preferably connects individual supply channels 212 of the discharge units 215 adjacent to each other, for example.

Fourth Embodiment

A head body 302*a* will be described with reference to FIG. 9. The head body 302*a* is substantially the same as the head body 202*a* depicted in FIGS. 6(*a*) and 6(*b*) in terms of the configuration of a channel for liquid, and a coupling channel 317 connects the individual collect channels 14. The head body 302*a* is provided with dampers 28A to 28E. A secondary channel member 304 is formed by stacking plates 304*a* to 3041 in order to provide the dampers 28A to 28E. Slightly different members will be denoted by identical reference numerals and will not be described repeatedly.

Figure 9:
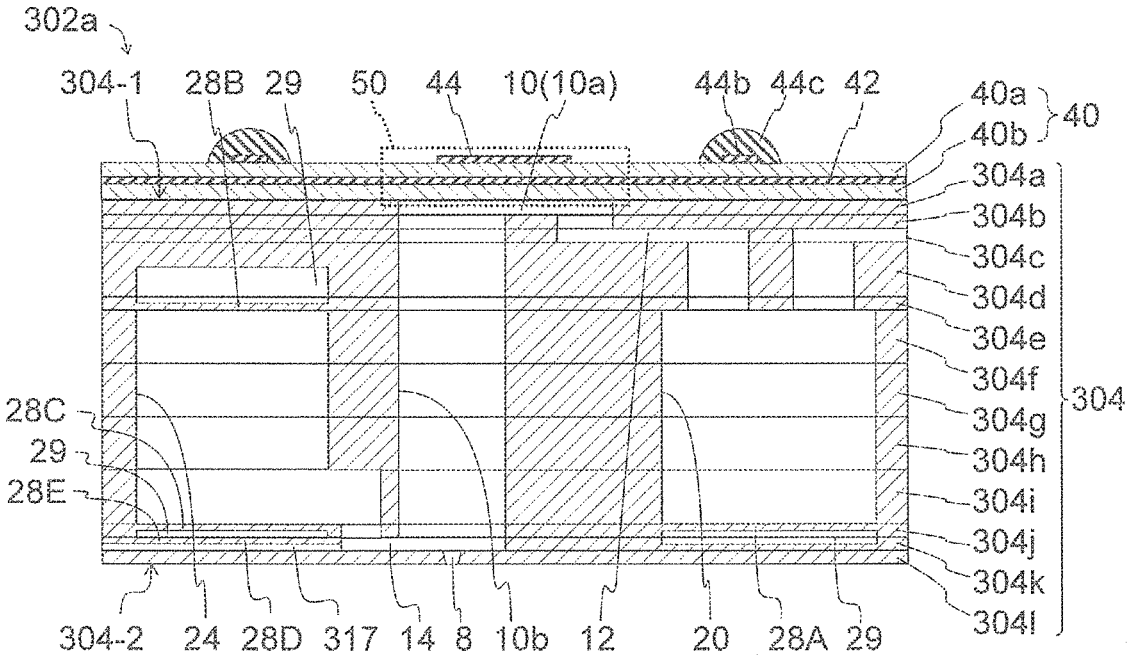
FIG. 9 is a longitudinal sectional view of a head body included in a liquid discharge head according to a fourth embodiment.

FIG. 9 is a longitudinal sectional view of a substantially same position as that of FIG. 5 (*b*). It is noted that FIG. 9 depicts a range expanded horizontally from the range of FIG. 5 (*b*) to include the entire sections of the secondary supply channel 20 and the secondary collect channel 24.

The damper 28A faces a surface adjacent to a discharge hole surface 304-2, of the secondary supply channel 20. The damper 28A has an opposite surface not facing the secondary supply channel 20 but facing a damper chamber 29, and is deformed by warping to change the volume of the secondary supply channel 20. This attenuates to reduce pressure variation of liquid in the secondary supply channel 20. Each of the dampers 28B to 28E to be described below basically has the same function.

The damper 28B faces a surface adjacent to a pressurization chamber surface 304-1, of a secondary collect channel 24. The damper 28B has an opposite surface not facing the secondary collect channel 24 but facing the damper chamber 29.

The damper 28C faces a surface adjacent to the discharge hole surface 304-2, of the secondary collect channel 24. The damper 28C has an opposite surface not facing the secondary collect channel 24 but facing the damper chamber 29. The individual collect channel 14 in the head body 302*a* is not connected to the surface adjacent to the discharge hole surface 304-2, of the secondary collect channel 24 but is connected to a side surface. Such connection allows the surface adjacent to the discharge hole surface 304-2, of the secondary collect channel 24 to serve as the damper 28C equal in width to the secondary collect channel 24, to achieve improvement in damper effect.

The coupling channel 317 has one end connected to a halfway portion of the individual collect channel 14 of one of the discharge units 15, and the other end connected to a halfway portion of the individual collect channel 14 of the adjacent discharge unit 15, outside the left end of the portion depicted in FIG. 9. The coupling channel 317 is configured by a groove provided in the discharge hole surface 304-2 of the plate 304*k* and closed by the nozzle plate 304*l*. The groove in the plate 304*k* can be formed by half etching or the like.

The coupling channel 317 is provided, on a surface adjacent to the discharge hole surface 304-2, with the damper 28D with an external space serving as a damper chamber. The coupling channel 317 is provided, on a surface adjacent to the pressurization chamber surface 304-1, with the damper 28E. The top and bottom surfaces of the coupling channel 317 thus have dampers to achieve a high pressure attenuation effect. This configuration reduces pressure transmission through the coupling channel 317 between the discharge units connected via the coupling channel 317.

The damper 28E has an opposite surface not facing the coupling channel 317 but facing the damper chamber 29. The damper 28D and the damper 28C face the identical damper chamber 29. Sharing the identical damper chamber 29 improves space utilization efficiency.

The embodiments of the present invention have been described above. The present invention should not be limited to these embodiments but can be modified in various manners without departing from the purpose of the invention. For example, the exemplified printer 1 includes the liquid discharge head 2 according to the first embodiment. The present invention is not limited to this case, and the printer 1 can alternatively include the liquid discharge head 102 or 202 according to the different embodiment. The printer can include the liquid discharge heads 2, 102, and 202 according to the plurality of embodiments in combination.

The present invention exemplifies the pressurizing part provided as a piezoelectric actuator substrate configured to pressurize the pressurization chamber 10 by means of piezoelectric deformation, but is not limited to this case. For example, each of the pressurization chambers 10 can be provided with a heating part and the pressurizing part can be configured to heat liquid in the pressurization chamber 10 with heat of the heating part and pressurize by means of thermal expansion of the liquid.

The flow of liquid in the liquid discharge head 2 can also be modified. Specifically, the circulating liquid can flow in an opposite direction. For example, the first to fourth channels can correspond to the individual collect channel 14, the individual supply channel 12, the secondary collect channel 24, and the secondary supply channel 20, respectively. In this case, liquid flows in the secondary collect channel 24, the individual collect channel 14, the partial channel 10*b*, the pressurization chamber body 10*a*, the individual supply channel 12, and the secondary supply channel 20 in the mentioned order.

DESCRIPTION OF THE REFERENCE NUMERALS

1: Color ink jet printer
2: liquid discharge head
2*a*, 101*a*, 202*a*, 302*a*: Head body
4: Secondary channel member
4*a*: Secondary channel member body
4*b*: Nozzle plate
4-1: Pressurization chamber surface
4-2: Discharge hole surface
6: Primary channel member
8: Discharge hole
9*a*, 9*b*: Discharge unit row
10: Pressurization chamber
10*a*: Pressurization chamber body
10*b*: Partial channel
12: Individual supply channel (first channel)
14: Individual collect channel (second channel)
15: Discharge unit
17, 117, 217, 317: Coupling channel (fifth channel)
20: Secondary supply channel (Third channel)
22: Primary supply channel
24: Secondary collect channel (fourth channel)
26: Primary collect channel
28A~E: Damper
29: Damper chamber
40: Actuator substrate
40*a*, 40*b*: Piezoelectric ceramics layer
42: Common electrode
44: Individual electrode
44*a*: Individual electrode body
44*b*: Extraction electrode
44*c*: Connection electrode
50: Displacement element
70: Head mount frame
90: Circuit board
P: Printing paper

The invention claimed is:

1. A liquid discharge head comprising:

a plurality of discharge units each including a discharge hole, a pressurization chamber communicating with the discharge hole, a first channel for supply of liquid to the pressurization chamber, and a second channel for collection of liquid from the pressurization chamber;

a pressurizing part for pressurizing the pressurization chamber;

a third channel connected commonly to the first channels of the plurality of discharge units, the third channel for supply of liquid to the discharge units;

a fourth channel connected commonly to the second channels of the plurality of discharge units, the fourth channel for collection of liquid from the discharge units; and a fifth channel connecting the discharge units to each other and having channel resistance larger than channel resistance of the first channel and the second channel.

2. The liquid discharge head according to claim 1, wherein the third channel and the fourth channel extend in a first direction, and the fifth channel extends in the first direction.

3. The liquid discharge head according to claim 2, wherein the plurality of discharge units is arrayed in the first direction, and the fifth channel connects three or more of the discharge units continuously adjacent to one another in the first direction.

4. The liquid discharge head according to claim 2, wherein the plurality of discharge units is arrayed in the first direction, and the fifth channel connects one of the discharge units and any one of the two discharge units adjacent in the first direction to the one of the discharge units.

5. The liquid discharge head according to claim 1, wherein the third channel and the fourth channel extend in the first direction, and the fifth channel extends in a second direction crossing the first direction.

6. The liquid discharge head according to claim 5, wherein the plurality of discharge units is disposed with the fourth channel being interposed therebetween, when a direction perpendicular to the first direction and the second direction is called as a third direction, the pressurizing part is positioned on one side in the third direction from the fourth channel, the discharge hole is positioned on the other side in the third direction from the fourth channel, and the fifth channel is positioned on the other side in the third direction from the fourth channel.

7. The liquid discharge head according to claim 5, wherein the plurality of discharge units is disposed with the third channel being interposed therebetween, when a direction perpendicular to the first direction and the second direction is called as a third direction, the pressurizing part is positioned on one side in the third direction from the third channel, the discharge hole is positioned on the other side in the third direction from the third channel, and the fifth channel is positioned on the one side in the third direction from the third channel.

8. The liquid discharge head according to claim 1, wherein the fifth channel faces a damper.

9. The liquid discharge head according to claim 1, wherein one end of the fifth channel is connected to the first channel or the second channel.

10. The liquid discharge head according to claim 9, wherein the other end of the fifth channel is connected to the first channel or the second channel.

11. The liquid discharge head according to claim 9, wherein the other end of the fifth channel is connected to the pressurization chamber.

12. The liquid discharge head according to claim 1, wherein the fifth channel connects the first channels to each other or the second channels to each other.

13. A recording device comprising:

the liquid discharge head according to claim 1;

a conveyor for conveying a recording medium to the liquid discharge head; and a controller for controlling the liquid discharge head.

* * * * *